United States Patent [19]

Deguchi

[11] Patent Number: 4,505,172

[45] Date of Patent: Mar. 19, 1985

[54] SHEAR ANGLE ADJUSTING APPARATUS FOR SHEARING MACHINE

[75] Inventor: Hideaki Deguchi, Komatsu, Japan

[73] Assignee: Kabushiki Kaisha Komatsu Seisakusho, Tokyo, Japan

[21] Appl. No.: 428,708

[22] Filed: Sep. 30, 1982

[30] Foreign Application Priority Data

Oct. 20, 1981 [JP] Japan ..... 56-154779[U]

[51] Int. Cl.[3] ..... B26D 5/08

[52] U.S. Cl. ..... 83/74; 83/636; 83/639; 83/640

[58] Field of Search ..... 83/640, 527, 575, 582, 83/588, 636, 637, 639, 72, 74, 624

[56] References Cited

U.S. PATENT DOCUMENTS

| | | | |
|---|---|---|---|
| 3,129,625 | 4/1964 | Jones | 83/624 |
| 3,131,589 | 5/1964 | Hazelton | 83/640 |
| 3,145,602 | 8/1964 | Pearson | 83/640 |
| 3,491,643 | 1/1970 | Meinholdt | 83/640 |
| 3,678,792 | 7/1972 | Dvorak | 83/588 |

FOREIGN PATENT DOCUMENTS 52-49588 12/1977 Japan .

*Primary Examiner*—James M. Meister
*Assistant Examiner*—John L. Knoble
*Attorney, Agent, or Firm*—Armstrong, Nikaido, Marmelstein & Kubovcik

[57] ABSTRACT

An automatic shear angle adjusting apparatus for a shearing machine comprising a first cylinder having a piston and piston rod unit mounted therein, the piston rod of the first cylinder being fixedly secured to the left end upper surface of an upper cutter, and a second cylinder having a piston and piston rod unit mounted therein, the piston rod of the second cylinder being fixedly secured to the right end upper surface of the upper cutter. A solenoid-operated valve is disposed in a conduit connecting a source of pressurized fluid with a rod end chamber of the first cylinder and a head end chamber of the second cylinder. A detector is arranged for detecting angular deflection of the upper cutter from a predetermined shear angle. Responsive to the detector is a control circuit which actuates the solenoid-operated valve either to connect the rod end chamber of the first cylinder and the head end chamber of the second cylinder to the source of pressurized fluid or to a drainage whereby shear angle is automatically adjusted and kept within a predetermined optimum shear angle.

3 Claims, 5 Drawing Figures

SHEAR ANGLE ADJUSTING APPARATUS FOR SHEARING MACHINE

BACKGROUND OF THE INVENTION

This invention relates to a shear angle adjusting apparatus for use in shearing machines.

In shearing operations of articles by means of a shearing machine, the shear angle is closely related with the accuracy of ariticles to be sheared; that is, camber, twisting and bowing of the articles and it is preferrable to limit the shear angle as small as possible.

To meet this purpose, there has been proposed a shear angle adjusting apparatus disclosed in the Japanese Patent Publication No. 52-49588 in which the shear angle can be varied depending on the thickness and material of articles to be cut to thereby improve the dimensional accuracy of sheared articles.

However, such an apparatus is disadvatageous in that it requires the provision of a multiplicity of changeover valves and is therefore expensive in cost and also requires complicated piping arrangements.

SUMMARY OF THE INVENTION

It is therefore an object of the present invention to provide a shear angle adjusting apparatus for a shearing machine which overcomes the above noted problems of prior art.

Another object of the present invention is to provide a shear angle adjusting apparatus for a shearing machine which is simple in construction yet can effect a reliable automatic shear angle adjustment. In accordance with an aspect of the present invention, there is provided a shear angle adjusting apparatus for a shearing machine having upper and lower shearing cutters, the upper shearing cutter being adapted to be displaced relative to the lower shearing cutter, comprising: a frame; first cylinder means mounted to said frame, said first cylinder means having mounted therein a piston and piston rod unit defining a head end and a rod end chamber therein, the piston rod of said first cylinder means being fixedly secured to one end upper surface of said upper cutter; second cylinder means mounted to said frame, said second cylinder means having mounted therein a piston and piston rod unit defining a head end and a rod end chamber therein, the piston rod of said second cylinder means being fixedly secured to the other end upper surface of said upper cutter; first source of pressurized fluid; solenoid-operated valve means connected at its input side with said first source of pressurized fluid, output side of said solenoid-operated valve means being connected with the rod end chamber of said first cylinder means and the head end chamber of said second cylinder means; means for detecting angular deflection of said upper cutter from a predetermined shear angle between said upper and lower cutters; and means responsive to said detecting means for actuating said solenoid-operated valve means either to connect the rod end chamber of said first cylinder means and the head end chamber of said second cylinder means to said first source of pressurized fluid or to a drainage whereby shear angle is automatically adjusted and kept within a predetermined optimum shear angle.

The above and other objects, features and advantages of the present invention will be readily apparent from the following description taken in conjunction with the accompanying drawings.

DESCRIPTION OF THE PREFERRED EMBODIMENT

The present invention will now be described in detail below by way of example only with reference to the accompanying drawings.

Figure 1:
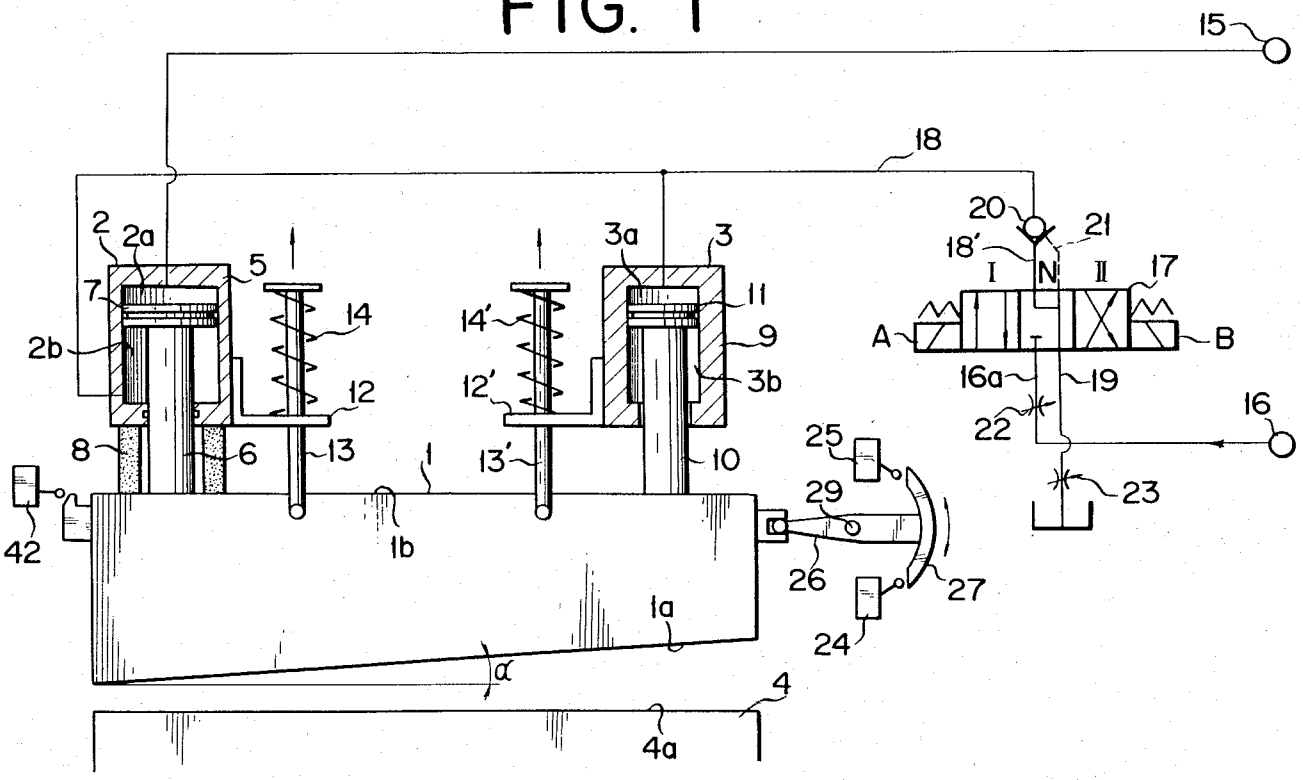
FIG. 1 is a schematic construction view of a shear angle adjusting apparatus for a shearing machine according to the present invention.

FIG. 1 is an overall front view wherein an upper cutter 1 is arranged to be vertically moved by a pair of left and right cylinders 2 and 3 relative to a lower cutter 4 and the lower face 1*a* of the upper cutter 1 is inclined relative to the upper face 4*a* of the lower cutter 4 to form a shear angle $\alpha$.

The left cylinder 2 comprises a cylinder barrel 5 in which a piston 7 having a piston rod 6 is slidably mounted to form a lowering chamber 2*a* and a raising chamber 2*b*. The piston rod 6 is connected to the upper cutter 1 and an upper limit stopper 8 for the upper cutter 1 is provided between the upper face 1*b* of the upper cutter 1 and the cylinder barrel 5.

The right cylinder 3 comprises a cylinder barrel 9 in which is slidably mounted a piston 11 having a piston rod 10 to form a lowering chamber 3*a* and a raising chamber 3*b*, the raising chamber 3*b* having an opening communicating with the atmosphere.

Further, inserted into brackets 12 and 12' fixedly secured to the cylinder barrels 5 and 9 are rods 13 and 13', respectively, which are both connected to the upper cutter 1 and are biased upwardly by means of springs 14 and 14'.

A hydraulic fluid source 15 is connected to the lowering chamber 2*a* of the left cylinder 2, whilst a hydraulic fluid source 16 is arranged to be connected with or disconnected from a conduit 18 through a solenoid-operated valve 17. The conduit 18 is connected to the raising chamber 2*b* of the left cylinder 2 and the lowering chamber 3*a* of the right cylinder 3.

Stating in brief, the solenoid-operated valve 17 has a neutral position N where a delivery conduit 16*a* of the hydraulic fluid source 16 is blocked and a conduit 18' is connected with a drain passage 19. The solenoid-operated valve 17 is shifted to a first offset position I where the delivery conduit 16*a* is allowed to communicate with the conduit 18' when a first solenoid "A" is energized and to its second offset position II where the delivery conduit 16*a* is allowed to communicate with a pilot line 21 of a check valve 20 disposed in the conduit 18 and the conduit 18 is connected to the drain passage 19 when a second solenoid "B" is energized. Reference numeral 22 and 23 denote variable restrictor valves installed in the delivery conduit 16*a* and the drain passage 19, respectively.

Reference numerals 24 and 25 denote first and second switches, respectively, which are adapted to be rendered on and off by means of a dog 27 fitted to an oscillating rod 26 whch is adapted to be vertically oscillated by the vertical movements of the upper cutter 1.

Figure 2:
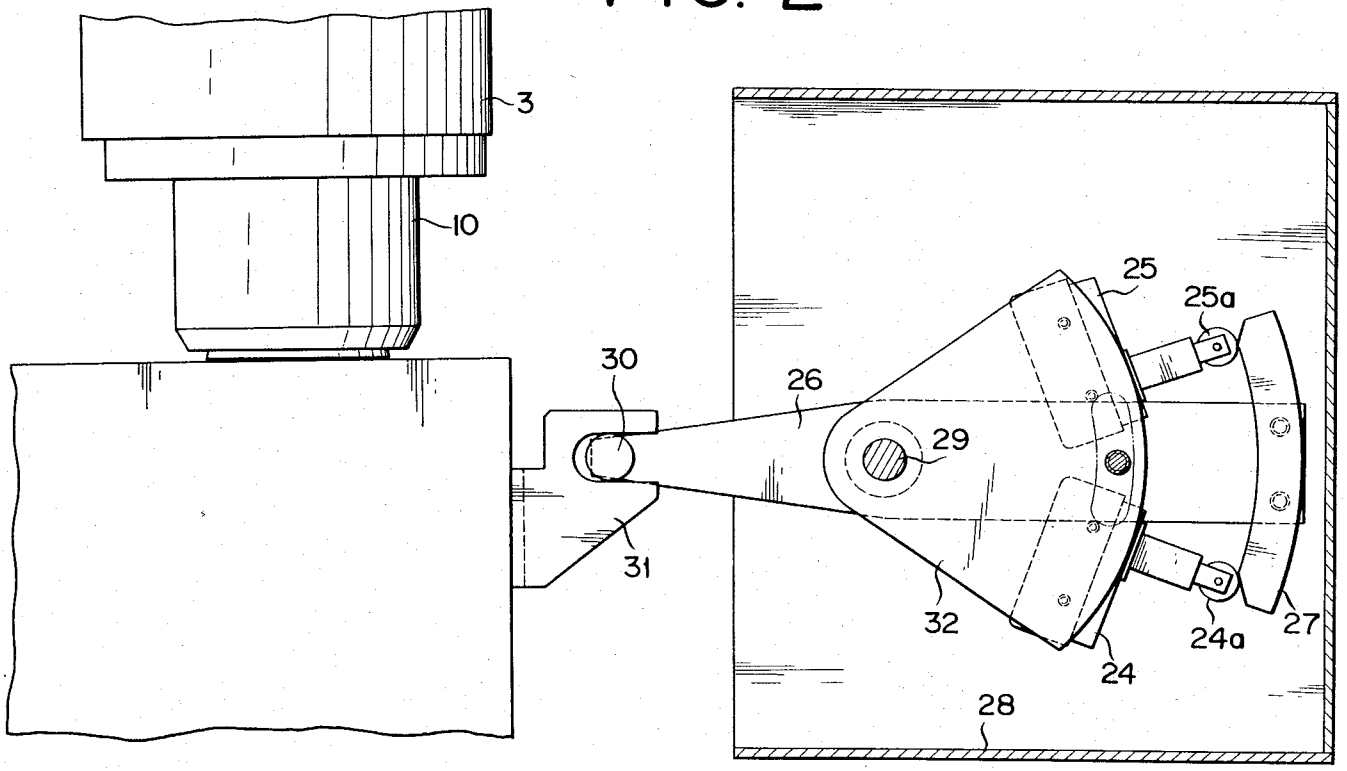
FIG. 2 is a front elevational view, partly in cross-section, showing a detector means employed in the present invention.
Figure 3:
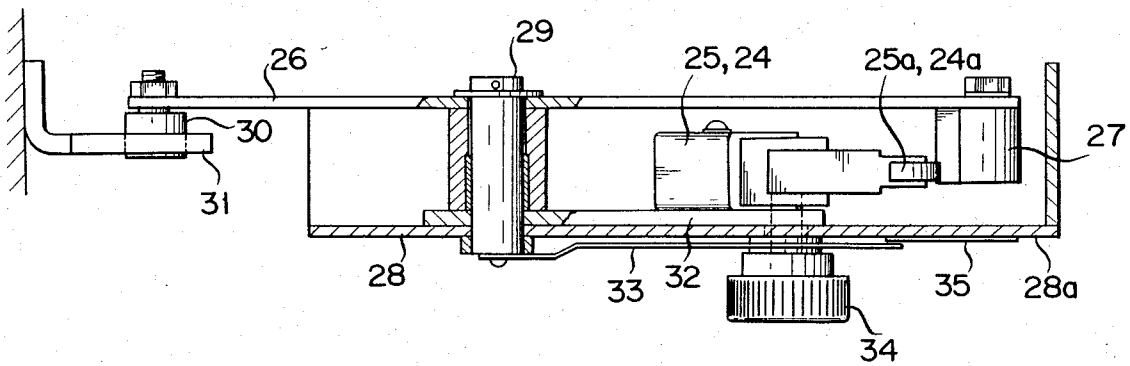
FIG. 3 is a cross-sectional view of the detector means shown in FIG. 2.
Figure 4:
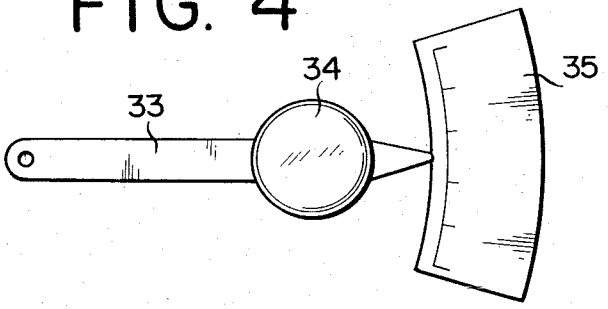
FIG. 4 is a schematic representation of a pointer assembly employed in the present invention.

Stated in brief, as shown in FIGS. 2, 3 and 4, the oscillating rod 26 is pivotally carried by a pin 29 fixedly secured to a casing 28. A roller 30 mounted on one end of the oscillating rod 26 is fitted in a forked york 31, and fixedly secured to a mounting plate 32 which is turn is pivotally mounted to the pin 29 are the first switch 24 and the second switch 25 having switch contacts 24*a* and 25*a*, respectively, which are located opposite to the dog 27. Both a pointer 33 pivotally mounted to the pin 29 and the mounting plate 32 are fixedly secured to the front wall 28*a* by means of a bolt 34 passing through the front wall 28*a* of the casing 28. The front wall 28*a* of the casing 28 has a scale plate 35 fitted thereto.

Figure 5:
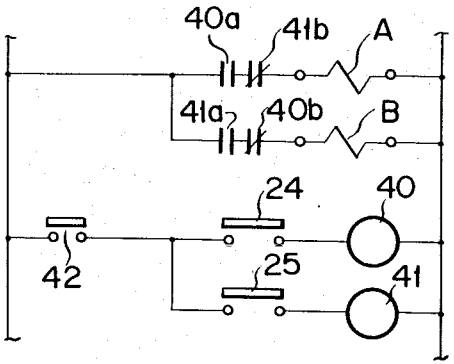
FIG. 5 is a diagram showing an electric circuitry used in the present invention.

FIG. 5 shows an electric circuit in which the first switch 24 and the first relay 40 and the second switch 25 and the second relay 41 are connected in series with an upper limit switch 42, respectively. Further, in this circuit, a normally-open contact 40*a* of the first relay 40 and a normally-closed contact 41*b* of the second relay 41 are connected in series with the first solenoid "A", and a normally-closed contact 40*b* of the first relay 40 and a normally-open contact 41*a* of the second relay 41 are connected in series with the second solenoid "B".

Thus, if the shear angle $\alpha$ corresponds to a predetermined optimum value when the upper cutter 1 abuts against the upper stopper 8 thereby rendering the upper limit switch 42 on, then the first and second switches 24 and 25 are turned off so that the first and second solenoids "A" and "B" are kept deenergized thus holding the solenoid-operated valve 17 at its neutral position N.

If the shear angle $\alpha$ is larger than the predetermined value, then the oscillating rod 26 is oscillated clockwise so as to move the dog 27 down thereby turning the first switch 24 on.

As a result, the first relay 40 is energized to open its normally-closed contact 40*b* and close its normally-open contact 40*a* thereby energizing the first solenoid "A" so that the solenoid-operated valve 17 may be shifted to its first offset position I. Consequently, the fluid under pressure delivered from the hydraulic fluid source 16 is supplied into the raising chamber 2*b* of the left cylinder 2 and the lowering chamber 3*a* of the right cylinder 3 with the result that the upper cutter 1 is lowered at its right hand end thereby reducing the shear angle $\alpha$ and at the same time turning the oscillating rod 26 counterclockwise to thereby move the dog 27 upwards.

When the shear angle $\alpha$ has attained the predetermined value, the dog 27 is disengaged from the switch contact 24*a* of the first switch 24 to turn off the latter thereby allowing the solenoid-operated valve 17 to return to its neutral position N and the shear angle to resume the predetermined value.

In case the shear angle $\alpha$ is less than the predetermined value, the second switch 25 is turned on by the dog 27 to thereby energize the second relay 41 and hence the second solenoid "B" so that the solenoid-operated valve 17 may be shifted to its second position II. Consequently, the check valve 20 is opened by the pilot pressure, and as a result, the pressurized fluid within the raising chamber 2*b* of the left cylinder 2 and the lowering chamber 3*a* of the right cylinder 3 is allowed to flow through the check valve 20 into the drain passage 19 so that the right hand end of the upper cutter is moved up thereby increasing the shear angle $\alpha$. When the shear angle $\alpha$ has reached the predetermined value, in the same manner as aforementioned, the solenoid-operated valve 17 will return to its neutral position N.

Thus, the shear angle $\alpha$ can always be kept at the predetermined optimum value.

Stated in brief, the shear angle $\alpha$ will vary depending on the sum of the quantity of the pressurized fluid within the raising chamber 2*b* of the left cylinder 2 and the lowering chamber 3*b* of the right cylinder 3 and that in the conduit 18; that is, the more the quantity of the fluid the smaller the shear angle $\alpha$, and the less the quantity of the fluid the greater the shear angle $\alpha$.

Further, it is to be noted that the check valve 20 is provided to reduce the amount of fluid leaks and to reduce the number of times of correction of the shear angle.

Moreover, it is possible to vary or adjust the shear angle $\alpha$ by loosening the bolt 34 and pivoting the mounting plate 32 to thereby move the first and second switches 24 and 25 up or down.

As described hereinabove, according to the present invention, the shear angle can be kept at a predetermined value and it can be adjusted as desired, and further the construction of the apparatus is simple in that it is only necessary to provide the solenoid-operated valve 17 and the first and second switches 24 and 25.

It is to be understood that the foregoing description is merely illustrative of a preferred embodiment of the invention, and that the scope of the invention is not to be limited thereto, but is to be determined by the scope of the appended claims.

What is claimed is:

1. A shear angle adjusting apparatus for a shearing machine having upper and lower shearing cutters, the upper shearing cutter being adapted to be displaced relative to the lower shearing cutter, comprising:

a frame; first cylinder means mounted to said frame, said first cylinder means having mounted therein a piston and piston rod unit defining a head end and a rod end chamber therein, the piston rod of said first cylinder means being fixedly secured to one end upper surface of said upper cutter;

second cylinder means mounted to said frame, said second cylinder means having mounted therein a piston and piston rod unit defining a head end and a rod end chamber therein, the piston rod of said second cylinder means being fixedly secured to the other end upper surface of said upper cutter;

first source of pressurized fluid;

solenoid-operated valve means connected at its input side with said first source of pressurized fluid, output side of said solenoid-operated valve means being connected with the rod end chamber of said first cylinder means and the head end chamber of said second cylinder means;

means for detecting angular deflection of said upper cutter from a predetermined shear angle between said upper and lower cutters, said detecting means further comprising a rod pivotally mounted at an intermediate portion thereof to said frame, said rod having a dog at one end thereof between a first switch means and a second switch means and having the other end engaged with said upper cutter, said first switch means adapted to be switched on by said dog when the shear angle between said upper and lower cutters becomes too big and said second switch means adapted to be switched on by said dog when the shear angle becomes too small; and a pilot-opened check valve disposed in a conduit connecting the output side of said solenoid-operated valve means with the rod end chamber of said solenoid-operated valve means with the rod end chamber of said first cylinder means and the head end chamber of said second cylinder means, said check valve allowing a flow of fluid from said solenoid-operated valve means but normally blocking the flow of fluid in the opposite direction, said check valve when pilot-opened allowing the flow of fluid in said opposite direction and wherein said solenoid-operated valve means has a neutral blocking position, a first offset position where said first source of pressurized fluid is communicated with the rod end chamber of said first cylinder means and the head end chamber of said second cylinder means, and a second offset position where said check valve is pilot-opened by the fluid pressure from said first source of pressurized fluid and the rod end chamber of said first cylinder means and the head end chamber of said second cylinder means are connected with the drainage through said pilot-opened check valve.

2. A shear angle adjusting apparatus as recited in claim 1 further comprising conduit means for connecting the rod end chamber of said first cylinder means with the head end chamber of said second cylinder means, second source of pressurized fluid connected with the head end chamber of said first cylinder means and means connected to said upper cutter for biasing the same upwards away from said lower cutter.

3. A shear angle adjusting apparatus for a shearing machine having upper and lower shearing cutters, the upper shearing cutter being adapted to be displaced relative to the lower shearing cutter, comprising: a frame;

first cylinder means mounted to said frame, said first cylinder means having mounted therein a piston and piston rod unit defining a head end and a rod end chamber therein, the piston rod of said first cylinder means being fixedly secured to one end upper surface of said upper cutter:

second cylinder means mounted to said frame, said second cylinder means having mounted therein a piston and piston rod unit defining a head end and a rod end chamber therein, the piston rod of said second cylinder means being fixedly secured to the other end upper surface of said upper cutter;

first source of pressurized fluid;

solenoid-operated valve means connected at its input side with said first source of pressurized fluid, output side of said solenoid-operated valve means being connected with the rod end chamber of said first cylinder means and the head end chamber of said second cylinder means;

means for detecting angular deflection of said upper cutter from a predetermined shear angle between said upper and lower cutters, said detecting means further comprising a rod pivotally mounted at an intermediate portion thereof to said frame, said rod having a dog at one end thereof and having the other end engaged with said upper cutter, first switch means adapted to be switched on by said dog when the shear angle between said upper and lower cutters becomes too big and second switch means adapted to be switched on by said dog when the shear angle becomes too small;

means responsive to said detecting means for actuating said solenoid-operated valve means either to connect the rod end chamber of said first cylinder means and the head end chamber of said second cylinder means to said first source of pressurized fluid or to a drainage whereby shear angle is automatically adjusted and kept within a predetermined optimum shear angle; and a pilot-opened check valve disposed in a conduit connecting the output side of said solenoid-operated valve means with the rod end chamber of said first cylinder means and the head end chamber of said second cylinder means, said check valve allowing a flow of fluid from said solenoid-operated valve means but normally blocking the flow of fluid in the opposite direction said check valve when pilot-opened allowing the flow of fluid in said opposite direction and wherein said solenoid-operated valve means has a neutral blocking position, a first offset position where said first source of pressurized fluid is communicated with the rod end chamber of said first cylinder means and the head end chamber of said second cylinder means, and a second offset position where said check valve is pilot-opened by the fluid pressure from said first source of pressurized fluid and the rod end chamber of said first cylinder means and the head end chamber of said second cylinder means are connected with the drainage through said pilot-opened check valve.

* * * * *